US006144749A

United States Patent [19]

Fideler

[11] Patent Number: 6,144,749

[45] Date of Patent: Nov. 7, 2000

[54] HEARING AID FACEPLATE AND BATTERY COMPARTMENT

[75] Inventor: Brian Fideler, Jordan, Minn.

[73] Assignee: Starkey Laboratories, Inc., Eden Prairie, Minn.

[21] Appl. No.: 09/057,387

[22] Filed: Apr. 8, 1998

[51] Int. Cl.[7] ..... H04R 25/00

[52] U.S. Cl. ..... 381/323; 381/312; 381/328; 381/322

[58] Field of Search ..... 381/323, 312, 381/322, 324, 328, 330; 181/129, 130, 135; 439/500, 504; 429/96, 97, 100, 123

[56] References Cited

U.S. PATENT DOCUMENTS 4,815,138 5/1989 Diethelm ..... 381/323
4,941,180 7/1990 Buettner ..... 381/323
5,675,657 10/1997 Giannetti ..... 381/323
5,799,095 8/1998 Hanright ..... 381/312

*Primary Examiner*—Sinh Tran
*Attorney, Agent, or Firm*—Jay H. Maioli

[57] ABSTRACT

A battery enclosure for a small electronic device includes a flexible strip connecting an enclosure door with an inside surface of the device body. When the door is open, the strip forms a sling across the enclosure opening. The strip also forms a living hinge to hold the door to the device body. A button type battery is inserted into the opening against the strip and the door is pushed into the opening. Catchments hold the door within the opening. When the door is opened and the strip is pulled outward by the strip provides a force to push the battery out of the opening.

9 Claims, 4 Drawing Sheets

HEARING AID FACEPLATE AND BATTERY COMPARTMENT

BACKGROUND OF THE INVENTION

The present invention relates generally to the field of battery compartments for small electronic devices. More particularly, the present invention relates to a battery compartment and door wherein the battery is supported on a flexible strap and where the strap also forms a living hinge for the compartment door.

Enclosures for button-type batteries for miniature electronic devices, such as hearing aids, present a number of design challenges. Batteries for these devices are necessarily small and difficult to manipulate. A battery compartment that simplifies the task of changing batteries is desirable.

The overall size of the hearing aid must be small to provide acceptable user comfort and esthetic appearance. It is therefore desirable that the battery enclosure itself occupy a minimum volume. Structures that serve dual purposes are also desirable since this reduces the number of parts required and has a positive impact on the size of the device.

Known methods of forming battery compartments for miniature electronic devices suffer from a number of defects. Typically a door is provided on the surface of the device that admits a button battery into a chamber. The battery is forced edge-wise into the chamber and spring electrodes press the faces of the battery to supply power to the device.

A high force applied by the spring electrodes is desirable, since this increases the reliability of the electrical contact between the battery and the electrodes. Also, a high spring force improves the wiping action of the springs against the battery, thereby removing dirt and corrosion between the battery and the electrodes.

Such a high spring force creates a problem, however, and removal of a drained battery from the compartment is difficult because the battery is held tightly between the springs. The batteries typically used for this kind of application are quite small and difficult to grasp. Extraction is frequently accomplished by the so-called "rapid deceleration" method, that is, by slamming the device against the user's palm. Such treatment of expensive electronic equipment is less than desirable.

Another method of providing a battery enclosure is to form an opening in a surface of the hearing aid large enough to admit a button battery face first. A spring electrode is provided at the bottom of the opening. A door, usually including a second spring electrode, is then locked down on top of the battery.

This method solves the problem of battery extraction but introduces other problems. A relatively large door must be provided, increasing the device size. The door must include an electrical connection to the electrode, as well as a locking mechanism. This increases the complexity of the door, and makes the device more difficult to manufacture and less reliable.

An alternative method for inserting and extracting a battery from a small electronic device edge-wise is illustrated in U.S. Pat. No. 3,138,491 (Rubio). A frame is provided with an opening to accommodate the circumference of a button battery. One corner of the frame is hinged so that the frame rotates into the electronic device. A battery is placed within the frame and is carried edge-wise into the device between internal spring electrodes as the frame rotates into the device. When the frame is fully rotated into the device an exposed side of the frame forms the battery compartment door. A tab extends from the door. To remove the battery the user grasps the tab and rotates the frame out of the body of the device. The frame pulls the battery from between the electrodes.

The Rubio device solves the problem of extracting the battery. It is not ideal, however, because it requires a relatively complicated mechanism to form the battery compartment. Also, the frame and hinge must be accommodated within the device, which adversely impacts on the overall size of the device. In addition, the battery must be held in the frame by the user as the door is closed. The small sizes of the battery and the frame make this difficult.

SUMMARY OF THE INVENTION

In view of the aforementioned shortcomings of known battery enclosures, it is an object of the present invention to provide a battery enclosure for a miniature electronic device that more easily allows insertion and extraction of a battery.

It is another object of the present invention to provide a battery enclosure which has a minimum impact on the overall size of an electronic device.

It is a further object of the present invention to provide a battery enclosure that forms a part of the electrical circuit connecting an enclosed battery with a miniature electronic device.

DETAILED DESCRIPTION

Figure 1:
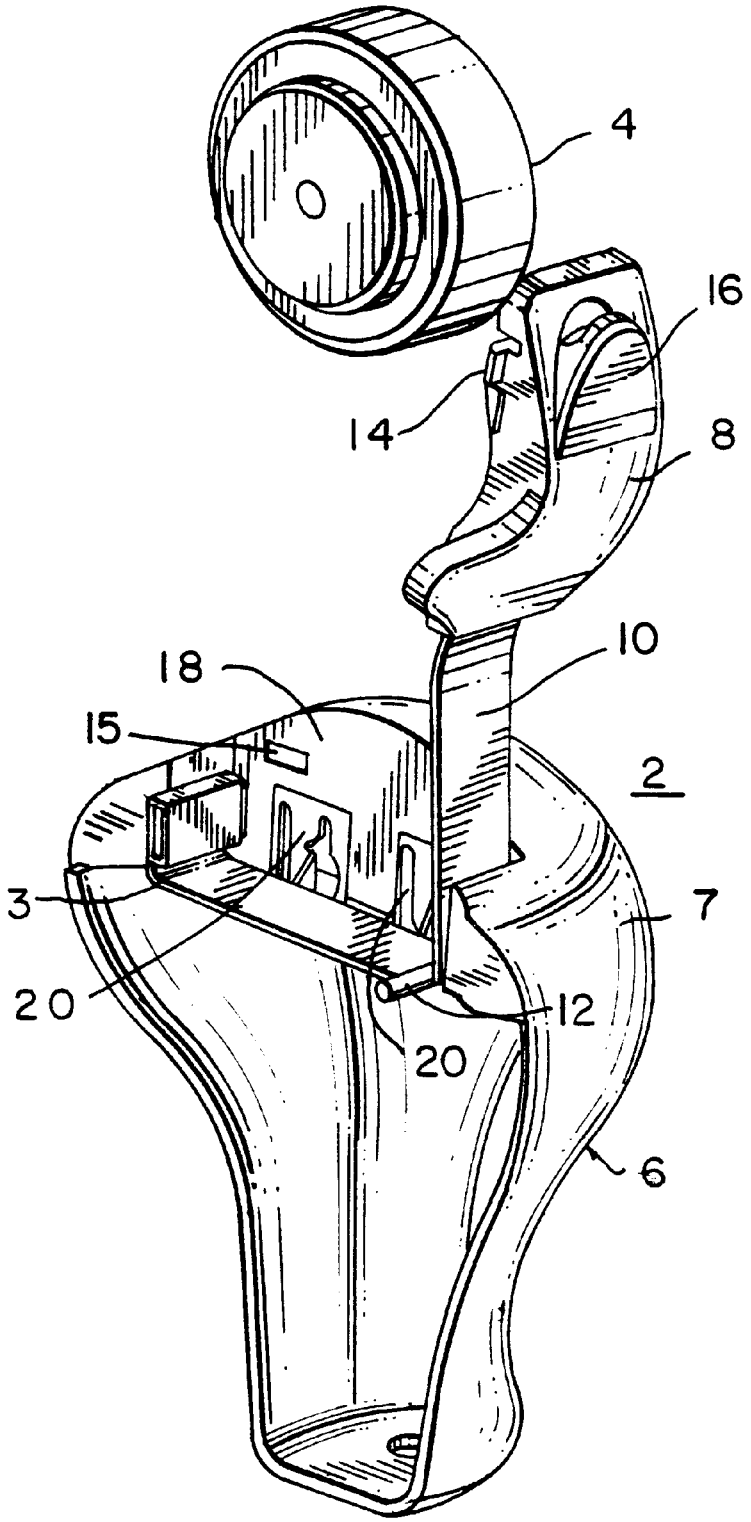
FIG. 1 shows a view of an electronic device according to a first embodiment of the present invention.

FIG. 1 shows a small electronic device 2, for example, a hearing aid, constructed according to a first embodiment of the present invention. A faceplate 7 is disposed on the top of a case 6 and forms the outer surface of the hearing aid 2. One side of the case 6 and faceplate 7 have been shown cut away to more clearly illustrate the invention.

The faceplate 7 has an opening 18 to admit a button-type battery 4 edge-wise. The shape of the opening 18 is designed to prevent the battery 4 from being inserted with an incorrect polarity.

At one side of the opening 18, a flexible strip 10 is connected to the faceplate 7 by an anchor pin or point 3. The flexible strip 10 passes around a bridge pin 12, and the other end of the strip 10 is connected to the rear end of a door 8.

The flexible strip 10 forms a living hinge to connect the door 8 to the faceplate 7. With the door 8 removed from the faceplate 7, as shown in FIG. 1, the flexible strip 10 creates a sling between the anchor point 3 and the bridge pin 12.

The front end of the door 8 has catchment protrusions 14. These protrusions 14 are designed to fit within catchments 15 on the inside surfaces of the opening 18 of the faceplate 7. When the door 8 is pressed into the opening 18, the catchment protrusions 14 engage the catchments 15 and hold the front end of the door 8 securely within the opening 18.

Figure 2:
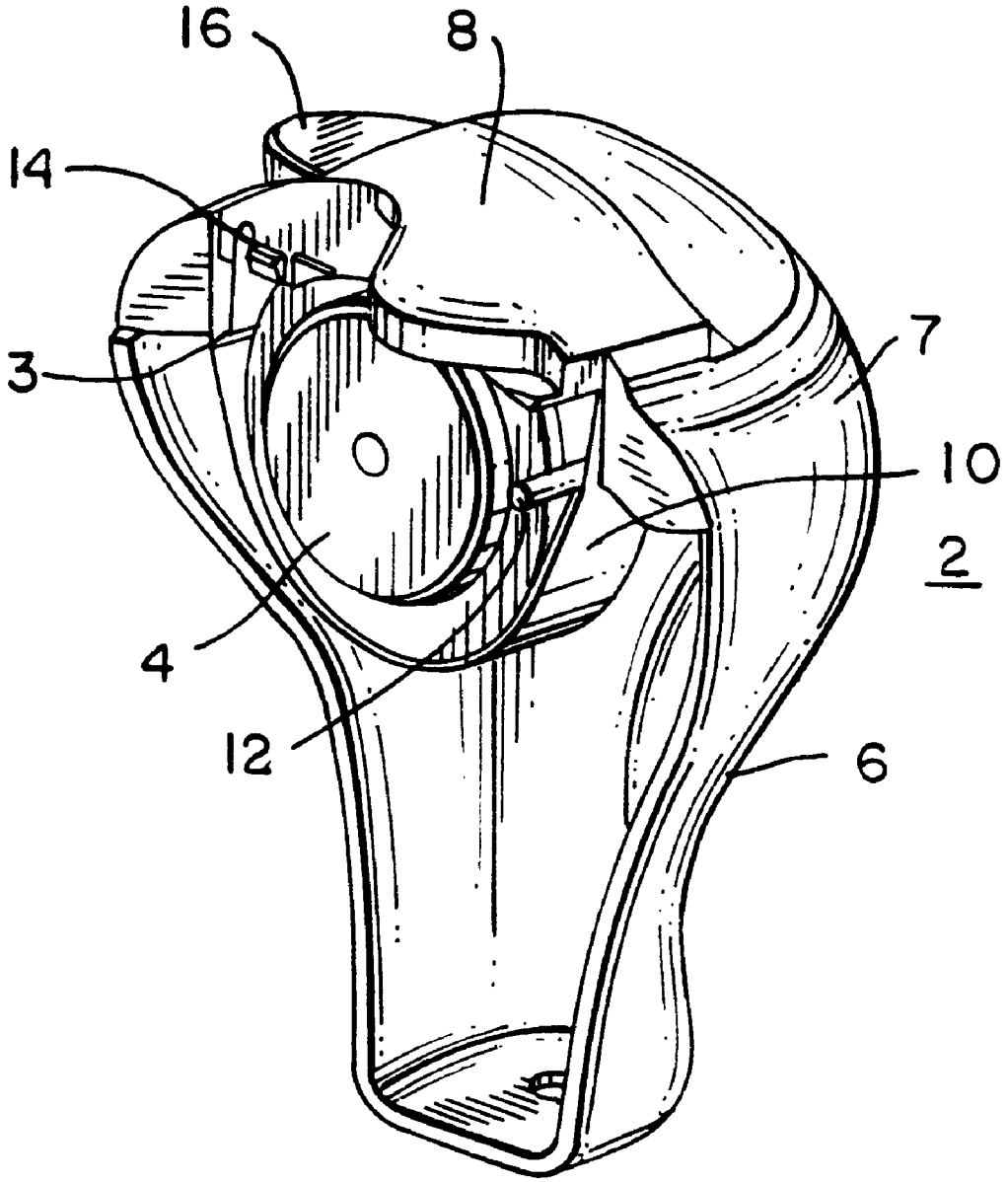
FIG. 2 shows the electronic device of FIG. 1 according to another aspect of the present invention.

FIG. 2 shows the same hearing aid 2 with the door 8 closed. The strip 10 fits around the circumference of the battery 4. The length of the strip 10 is selected to be substantially equal to the distance around the inserted battery 4. Tension on the strip 10 holds the rear end of the door 8 securely within the opening 18.

Figure 3:
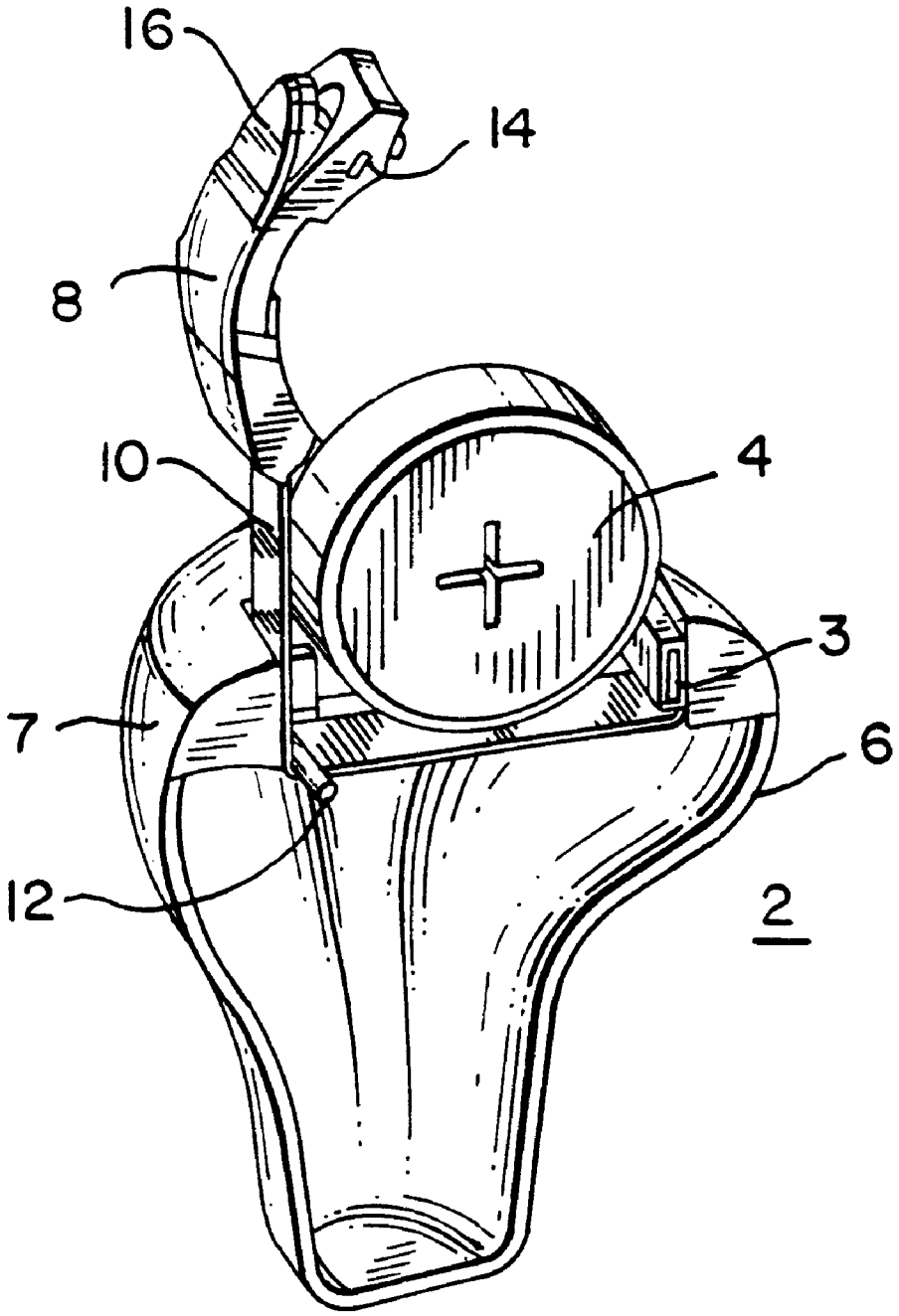
FIG. 3 shows the electronic device of FIG. 1 from an opposite view point.

A battery 4 is inserted into the hearing aid 2 as shown in FIG. 3. The battery 4 is pressed into the case 6 against the strip 10 and the door 8 is closed as shown in FIG. 2.

Electrodes 20, shown in FIG. 1, contact one terminal of the battery 4. Electrodes (not shown) on the other side of the opening 18 contact the other terminal of the battery 4. The electrodes 20 provide power from the battery 4 to the hearing aid 2.

Removal of the battery 4 is the reverse of the insertion operation. A tab 16 is provided on the top surface of the door 8. By lifting the tab 16 the catchment protrusions 14 on the front end of the door 8 are separated from the catchments 15. The door 8 is then pulled upward drawing the strip 10 around the bridge pin 12 and out of the case 6. Tension on the strip 10 lifts the battery 4 from between the contacts 20. The battery 4 is lifted to the position shown in FIG. 3 and can easily be removed from the hearing aid 2.

According to the first embodiment of the present invention, the flexible strip 10 is made of an insulating material. According to a preferred embodiment, the strip 10 is composed of Kapton polymer, manufactured by the Du Pont Company. Such a strip provides an electrically insulating layer around the circumference of the battery 4. This prevents short circuits between the metallic side of the battery 4 and electrical components of the hearing aid 2.

Figure 4:
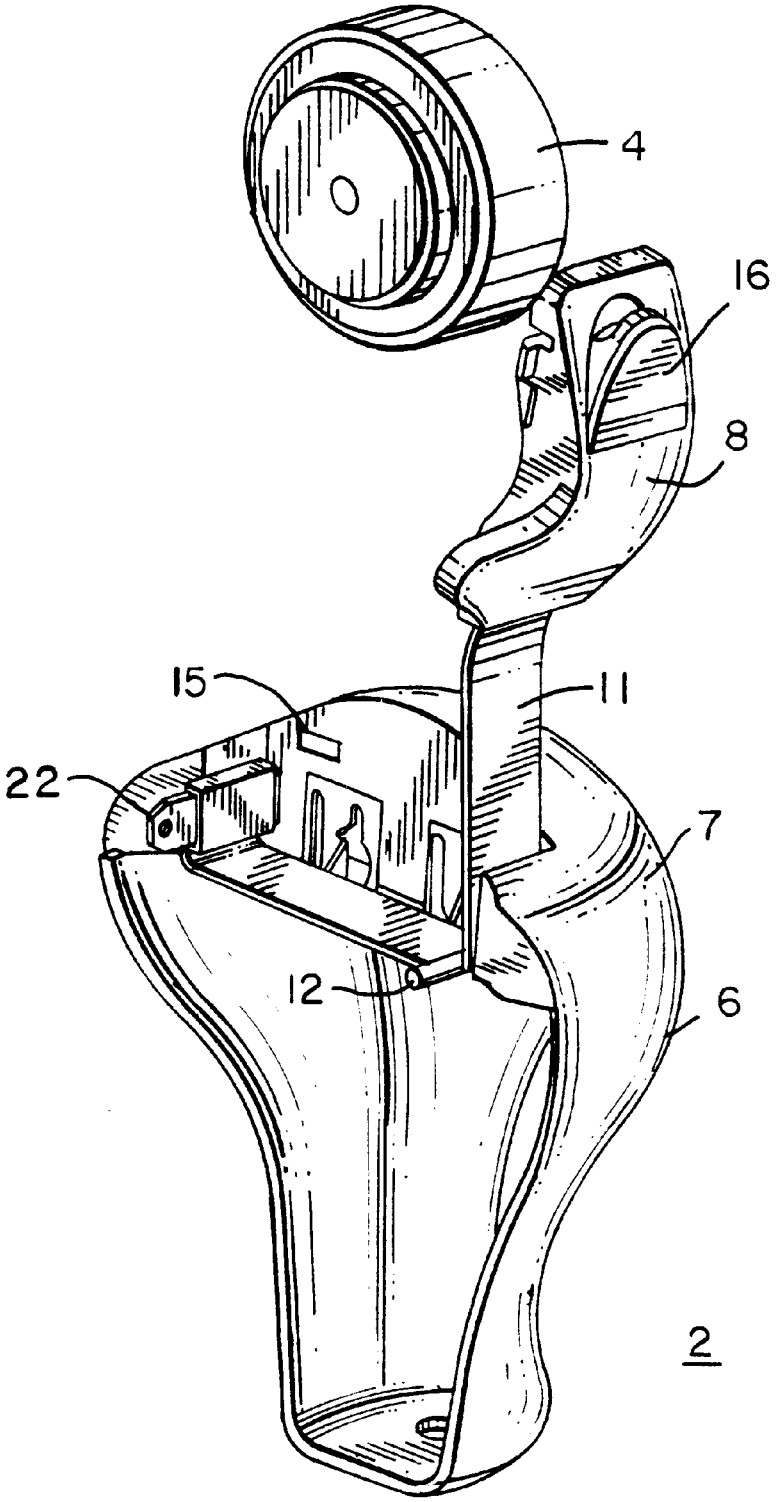
FIG. 4 shows a view of an electronic device according to a second embodiment of the present invention.

FIG. 4 shows another embodiment of a hearing aid 2 according to the present invention. The same or similar structures illustrated in FIGS. 1–3 are indicated by the same numerals. In this embodiment the strip 11 is formed, at least partially, of a flexible conductive material. This material may be a metal layer deposited on a polymer substrate, a conductivized polymer, or a woven metallic cloth.

As in the first embodiment, the strip 11 is fixed to the rear end of the door 8 and passes around a bridge pin 12. The conductive strip 11 contacts the circumference of the battery 4 creating an electrical contact. Where the strip 11 is fixed to the faceplate 7 an electrical connection 22 is provided. The electrical connection 22 conducts electrical current from the strip 11 to the hearing aid circuitry (not shown).

By eliminating spring electrodes for one pole of the battery 4, the number of components in the hearing aid 2 is reduced.

As an alternative to this embodiment the strip 11 can be formed of a non-conducting material such as Kapton, and circuit components can be formed on the strip 11 using known deposition and patterning techniques. Power regulation circuitry, for example, could be formed on the strip 11 between an electrode contacting the battery 4 and the electrical connection 22. By incorporating circuit elements onto the strip 11, the number of components required elsewhere in the hearing aid 2 can be reduced.

The embodiments described above are illustrative examples of the present invention. It should be understood that the present invention is not limited to these particular embodiments. Various changes may be effected by one skilled in the art without departing from the spirit or scope of the invention as defined in the appended claims.

What is claimed is:

1. An enclosure for a battery within an electronic device, the enclosure comprising:

a device body with an opening in a surface for accommodating the battery;

an enclosure door shaped to fit within the opening and including catchments for being removably connected at a front end thereof to the body within the opening;

a bridge pin disposed within the body near a rear end of the opening; and a flexible strip affixed at one end to an inside surface of the body near a front end of the opening, passing around the bridge pin and connected at an opposite end to a rear end of the door, wherein when the battery is inserted into the opening and the door is pushed into the opening the flexible strip forms a loop around the battery.

2. The enclosure according to claim 1 wherein the flexible strip is formed of an insulating material and the loop forms an insulating barrier around the battery.

3. The enclosure according to claim 2 wherein the flexible strip is formed of Kapton polymer.

4. The enclosure according to claim 1 further comprising a spring electrode mounted to the inside surface of the body within the opening and disposed to contact a first electrical terminal of the battery when the battery is inserted into the opening.

5. The enclosure according to claim 4 wherein the flexible strip is formed of a conductive material and wherein the strip contacts a second electrical terminal of the battery when the battery is inserted into the opening.

6. The enclosure according to claim 5 wherein the flexible strip is formed of a conductive polymer.

7. The enclosure according to claim 5 wherein the flexible strip is formed of a woven metallic cloth.

8. The enclosure according to claim 1 wherein the device is a hearing aid.

9. The enclosure according to claim 1 wherein the flexible strip is formed of an insulating material and wherein circuit components are formed on the surface of the strip.

* * * * *